US005816729A

United States Patent [19]

Whaley

[11] Patent Number: 5,816,729

[45] Date of Patent: Oct. 6, 1998

[54] RING BINDER WITH LOW PROFILE RING METAL

[75] Inventor: Paul Whaley, County of St. Francois, Mo.

[73] Assignee: US Ring Binder Corp., New Bedford, Mass.

[21] Appl. No.: 806,056

[22] Filed: Feb. 25, 1997

[51] Int. Cl.[6] ..... B42F 3/04

[52] U.S. Cl. ..... 402/31; 402/37; 402/38; 402/42

[58] Field of Search ..... 402/31, 36, 37, 402/38, 39, 40, 41, 42

[56] References Cited

U.S. PATENT DOCUMENTS

| | | | |
|---|---|---|---|
| 779,142 | 1/1905 | Trussell | 402/38 |
| 1,238,846 | 9/1917 | Trussell | 402/37 |
| 1,896,839 | 2/1933 | Dawson | 402/38 |
| 1,927,113 | 9/1933 | Dawson | 402/38 |
| 1,997,447 | 4/1935 | Birbaum | 402/38 |
| 2,088,431 | 7/1937 | Newman | 402/39 |
| 2,645,227 | 7/1953 | Segal | 402/38 |
| 5,660,490 | 8/1997 | Warrington | 402/36 |

*Primary Examiner*—Daniel W. Howell
*Assistant Examiner*—Adesh Bhargava
*Attorney, Agent, or Firm*—Polster, Lieder, Woodruff & Lucchesi, L.C.

[57] ABSTRACT

A ring binder (10) for holding hole punched sheets of paper (P) includes a low profile ring metal (20). A pair of leaves (28, 30) are hingedly connected to each other for relative movement of the leaves to each other. A plurality of binder rings (22, 24, 26) are each formed of a pair of ring halves (22*a*, 22*b*, 24*a*, 24*b*, 26*a*, 26*b*). One end of each ring half is attached to a separate one of the leaves whereby movement of the leaves moves the ring halves to open and close the binder. A shield (40) covers the leaves, and release levers (44, 46) are located at each end of the cover. The levers are operable by a user of the ring binder to open and close the binder. Both release levers extend substantially co-planar to the cover and the length of the cover and release levers generally corresponds to the length of a sheet paper stored in the binder. This allows the overall size of the binder to be smaller than that of a ring binder holding the same size sheets of paper but using a conventional ring metal construction.

18 Claims, 2 Drawing Sheets

RING BINDER WITH LOW PROFILE RING METAL

BACKGROUND OF THE INVENTION

This invention relates to ring binders used for holding quantities of paper or similar hole punched material to be stored, and more particularly, to a ring binder employing a low profile ring metal having a lever release mechanism by which the binder is readily opened and closed but which permits a binder holding a specific size of paper to be smaller in size than conventional binders for holding the same size paper.

Ring binders typically hold and store punched sheets of paper; although, other suitably punched materials can also be stored in a ringbinder. The locking/release mechanism commonly used in ringbinders includes a thumb or finger operated latch located at each end of the mechanism. To operate the mechanism, the user presses against the latch to pull apart (open) binder rings which secure the paper in place in the binder. Papers can then be inserted or removed from the binder. When ready, the user presses against separated sections of a binder ring or rings to snap or push them together into their closed position. Or, the user can push the latch in the opposite direction to also close the binder.

Current locking mechanisms have certain drawbacks. One of these is that the construction of the lever release mechanism limits the size of the paper or material held or stored in a ring binder. This is because the mechanism extends out from each end of the binder's ring metal first in the direction of the ring metal, and then orthogonal to it. As a consequence, the paper held in the binder must usually be smaller in length than the length of the ring metal. A second drawback has origins similar to the first. That is, because the paper held in a binder will typically be smaller than the binder, greater space is required to store paper of a certain size. If the size of the binder must be larger than the optimal size of the paper held in the binder, shelf space for the binders must be larger than would otherwise be necessary. Further, there is usually a thumb latch located at each end of the binder. The space needed to accommodate both latch members further increases the size of binder needed to store a given size of paper. If a lever release mechanism could be provided which allowed the size of the binder and the paper held in the binder to be approximately the same, substantial savings would be realized. This would further be true if the lever release mechanism, at the same time, provided both ease of opening and closing.

Another problem with ring binders is "throw". This term relates to the movement of paper from one side of the binder to the other such as might occur if the binder is flipped about during usage. The effect of "throw" is that movement of the paper is against the binder rings and the force exerted can cause the binder to be inadvertently opened with a spillage of paper. In ring binders using conventional ring metals, there is a spacing between the base of the ring metal and the spine of the binder to which it is attached that increases the radius of paper throw. A ring metal in which this distance is reduced will reduce the possibility of throw causing the binder to open.

BRIEF SUMMARY OF THE INVENTION

Among the several objects of the present invention may be noted the provision of a ring binder for holding punched sheets of paper or the like;

the provision of such a ring binder having a low profile ring metal construction of a unique design by which latch members located at respective ends of the ring metal extend generally co-planar with a cover or shield for the ring metal;

the provision of such a ring binder in which the length of the ring metal is shorter than conventional ring metals for the same size paper so to save material costs in fabricating the metal;

the provision of such a ring binder wherein even though the ring metal is a smaller size than conventional ring metals, the ring metal can be used with the same size binder as an equivalent conventional ring metal is used;

the provision of such a ring binder in which the lower profile of the cover/lever release portion of the ring metal does not effect the operability of the ring metal for opening and closing the binder;

the provision of such a binder in which the ring metal makes it substantially more difficult to open by paper "throw";

the provision of such a ring binder to available in a variety of sizes and in which paper larger in size than the length of the low profile ring metal can be accommodated; and, the provision of such a ring binder in which the ring metal is readily assembled to a binder and which provides cost savings over such conventional ring metals.

In accordance with the invention, generally stated, a ring binder for holding sheets of hole punched paper includes a low profile ring metal assembly. The ring metal includes a pair of leaves hingedly connected to each other for relative movement of the leaves. There are a plurality of binder rings each of which is formed of a pair of ring halves. One end of each ring half is attached to a separate one of the leaves so movement of the leaves moves the ring halves to open and close the ring binder. A shield or cover covers the leaves. User operated release levers are located at each end of the cover to move the leaves to open and close the binder. These release levers extend substantially co-planar to the cover and the length of the cover and release levers generally correspond to the length of a sheet paper stored in the binder. This allows the overall size of the binder to be smaller than that of a ring binder for holding the same size sheets of paper but using a conventional ring metal. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
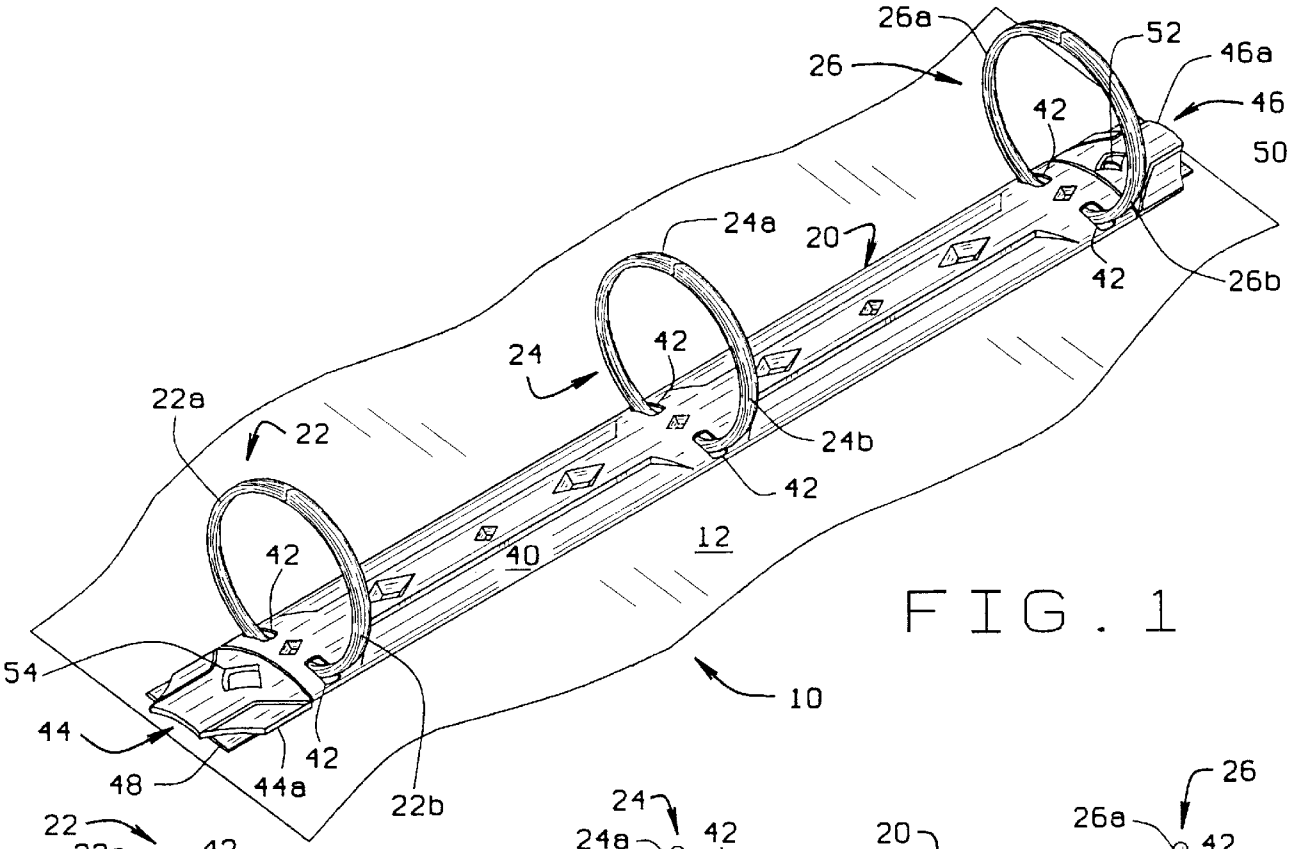
FIG. 1 is a perspective view of a ring metal for a binder of the present invention.
Figure 2:
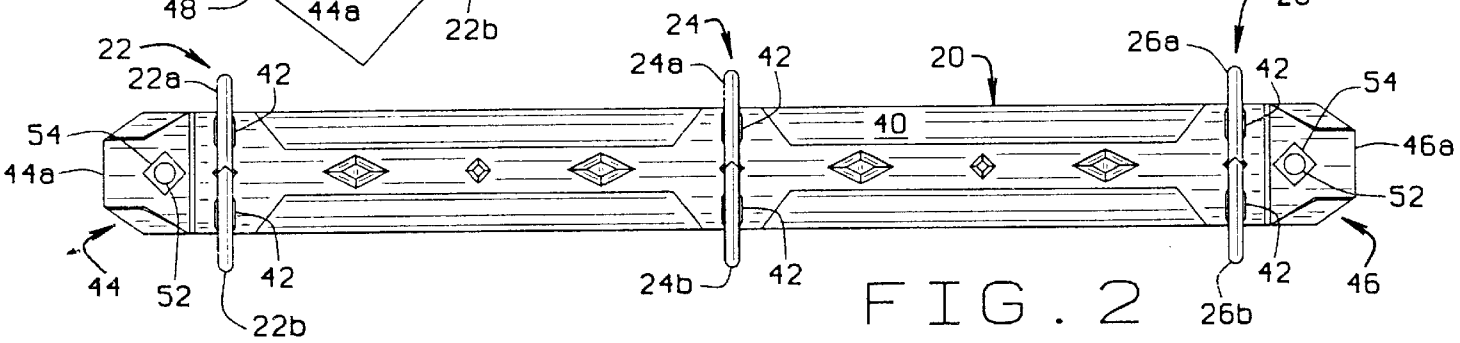
FIG. 2 is a top plan view of the ring metal.
Figure 3:
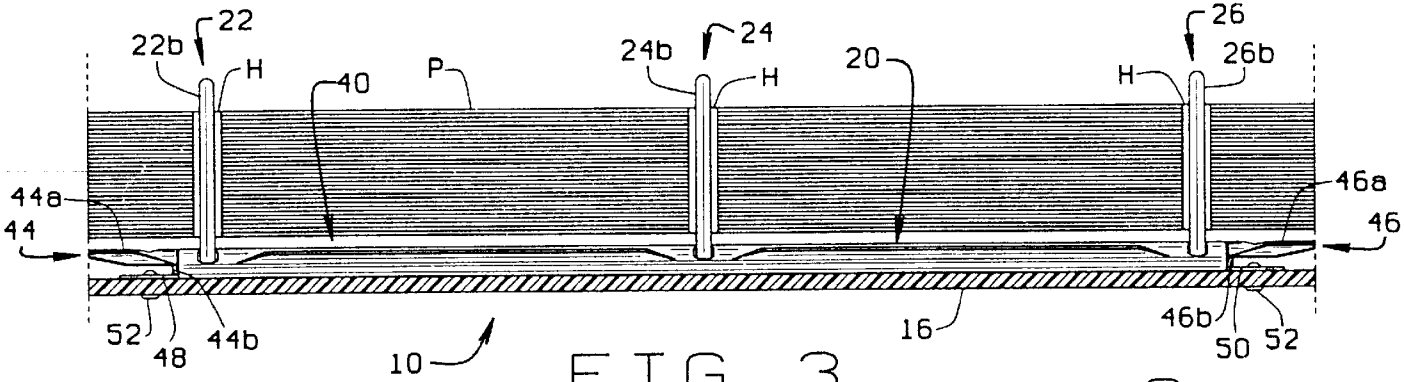
FIG. 3 FIG. 3 is a side elevational view of the ring metal.

Referring to the drawings, a ring binder indicated generally 10 in FIG. 1 has respective end covers 12 and 14, and a spine section 16 intermediate the end covers. As shown in FIG. 3, the ring binder is used to store sheets of paper P having holes H punched in them, or other suitably hole punched material. Ring binder 10 is available in various sizes to accommodate different sized sheets of paper and different quantities of paper. For this purpose, ring binder 10 is equipped with a low profile ring metal assembly 20, as described hereinafter, and which is attached to spine section 16 of the ring binder. The ring metal includes a plurality of openable and closeable binder rings 22, 24, 26 spaced axially along the length of the ring metal. Each ring is comprised of respective ring halves 22*a*, 22*b*, 24*a*, 24*b*, and 26*a*, 26*b*. While three binder rings are shown in the drawings, a ring binder may have more, or fewer, rings without departing from the scope of the invention.

The ring metal further includes a pair of leaves 28, 30 (shown in phantom in FIG. 6) which extend longitudinally of the ring metal. The leaves are each comprised of a rectangular plate. These plates extend parallel to each other along the length of the ring metal and are hingedly connected to each other by tabs 32, 34 for relative movement to each other when the ring binder is opened or closed. Each ring half has a base secured to one of the respective leaves, and the other end of the ring halves for each binder ring are formed to interfit with each other when the ring binder is closed. A cover or shield 40 fits over and encloses leaves 28, 30. The cover has spaced openings 42 formed therein at the location of each binder ring 22, 24, 26. The outer portion of each of the binder ring halves extends through one of these openings in the cover.

Figure 4:
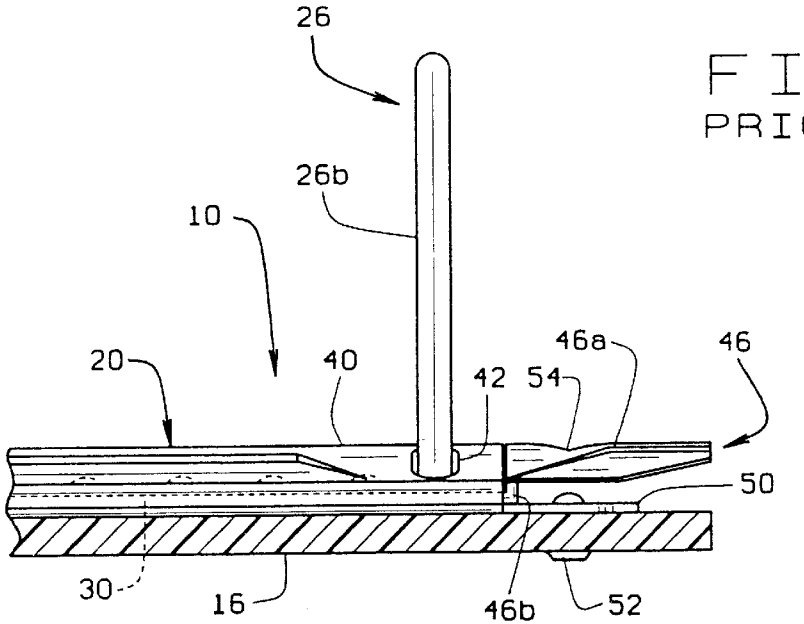
FIG. 4 is a partial side elevational view of the ring metal illustrating its attachment to a spine portion of a ring binder.

Mounted on opposite ends of the ring metal are release levers 44, 46. These release levers are operable by a user of the binder to move the hinged leaves in one direction to open the binder, and in the opposite direction to close it. Each release lever extends longitudinally of and co-planar with cover 40 of the ring metal. Each release lever includes a thumb or finger plate 44*a*, 46*a*, and a lever arm 44*b*, 46*b* depending beneath the plate. These lever arms extend through an opening in a respective bolster 48, 50 by which the low profile ring metal is attached to spine 16 of the binder by a fastener such as a rivet 52. Importantly, each plate 44*a*, 46*a* has an opening 54 therein. This opening is shown in the drawings to be diamond shaped, but the shape of the opening is immaterial. Rather, each opening 54 is larger than the head of the rivet 52 used to attach the respective end of the ring metal to the spine 16 of binder 10. Accordingly, each rivet is inserted through the respective openings in the thumb plates for attaching the ring metal bolster to the binder spine. This makes connection of the ring metal to the binder an easy operation during manufacture of the binder. The lever arms 44*b*, 46*b* are generally U-shaped arms by which the thumb or finger pressure applied to a plate is transmitted to the leaves 28, 30 to move them in the appropriate direction. Operation of the release levers to move the leaves in the appropriate direction to open or close a binder is well understood in the art, and will not be described. However, as shown in FIGS. 3 and 4, the installed ring metal is spaced closer to the binder spine 16 than would be a conventional ring metal. This increases the resistance of the ring metal to paper "throw" and makes the ring binder much less susceptible to inadvertent opening because of this.

Referring to FIG. 3, a major feature of the low profile ring metal can be readily seen. As shown in the drawing, the overall length of the ring metal, including the release levers at each end of the ring metal corresponds to the overall length of the sheets of paper to stored in the binder 10 in which the ring metal is used. The size of the ring binder can also be substantially the same size as that of the paper as indicated by the dashed lines in FIG. 3.

Figure 5:
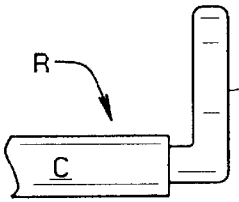
FIG. 5 PRIOR ART
FIG. 5 is a partial side elevational view of a prior art ring metal employing a conventional thumb latch used to open and close a binder; and, FIG. 6 is a side-by-side comparison of a ring metal of the present invention and a prior art ring metal illustrating the differences in length between the two for the same size paper.
Figure 6:
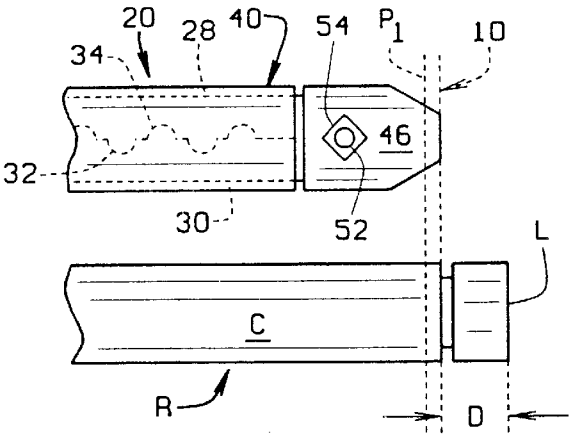

Referring to FIGS. 5 and 6, the substantial differences between the low profile ring metal of the present invention and a conventional ring metal are shown. In the prior art ring metal R of FIG. 5, a release lever L of conventional design is shown to extend outwardly from the end of a ring metal cover C, and then extend orthogonally to the cover. This prior art construction is also shown in FIG. 6. In FIG. 6, the edge of a sheet of paper P and of one side of ring binder 10 are also indicated by dashed lines. Because of the construction of a conventional release lever L, the thumb or finger portion of the release lever must extend beyond the end of the sheet of paper by a distance D. This is not so with the release mechanism of the low profile ring metal 20. Now, the end of the ring metal and sheet of paper coincide. As well, the outer edge of the binder can be closer to the edge of the paper. Although not shown, sheets of paper whose length exceeds that of ring metal 20 could also be stored in the binder. Because each release lever 44, 46 has a, contour generally corresponding to that of the release lever, the sheets of paper lie flat atop the ring metal assembly. The release lever is readily accessible with a downward pressure on the plate portion of the lever serving to open the binder. Closure is accomplished by an upward pressure on the plate, or by pushing together the open ends of any binder ring. Not only do the release levers of the ring metal take up less space than conventional release levers, but the release levers 44, 46 are also lighter in weight. For example, the outer ends of each plate 44*a*, 46*a* are beveled.

What has been described is a ring binder for holding punched sheets of paper, the ring binder employing a low profile ring metal construction in which latch members located at respective ends of the ring metal extend generally co-planar with a cover or shield for the ring metal. Because of this, the length of the ring metal is shorter than that of conventional ring metals for the same size paper so to save material costs in fabricating the metal. Accordingly, even though the ring metal is a smaller size than conventional ring metals, it is usable with the same size binder with which a conventional ring metal is used. The lower profile of the cover/lever release portion of the ring metal does not effect the operability of the ring metal for opening and closing the binder, and the ring binder to available in a variety of sizes. Finally, the ring metal is readily assembled to a binder in the same manner as a conventional ring metal.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A ring binder for holding hole punched sheets of paper comprising:

a pair of leaves hingedly connected to each other for relative movement therebetween;

at least one binder ring formed of a pair of ring halves, one end of each ring half attached to a separate one of the leaves for movement of said leaves to move the ring halves to open and close the ring binder;

a shield covering said leaves; and, a release lever located at one end of said shield, and operable by a user of said ring binder to move said leaves to open and close the binder, said release lever including a finger plate sized to receive a finger of the user to actuate said release levers, and a lever arm extending from said finger plate into engagement with said leaves to allow for movement of said leaves when said finger plate is actuated by the user, said finger plate extending substantially co-planar to said shield, the length of said shield and said finger plate generally corresponding to the length of a sheet paper stored in the binder thereby allowing the overall size of the binder to be smaller than that of a ring binder for holding the same size sheets of paper but using a conventional ring metal construction.

2. The ring binder of claim 1 wherein said shield has an arcuate contour, said finger plate an arcuate contour corresponding to the contour of said shield, and said leaves, binder ring, shield and release lever form a low profile ring metal for said ring binder.

3. The ring binder of claim 2 wherein the outer ends of each of said release levers are beveled inwardly to reduce the amount of material required to fabricate the levers.

4. The ring binder of claim 1 wherein said lever arm is a U-shaped lever arm extending through an opening formed in said leaves for said arm to press against one side of said leaves to open said binder and an opposite side of said leaves to close said binder.

5. The ring binder of claim 2 further including an opening in said finger plate, said opening being sized for insertion of a fastener therethrough, said fastener being used to secure said ring metal to said binder.

6. The ring binder of claim 5 further including respective end covers and a spine section intermediate said end covers, said ring metal including a bolster at the end of said ring metal at which said finger plate is disposed, said bolster being connected to said release lever, said bolster having an opening formed therein that is sized to receive said fastener, said fastener being used to secure said bolster to said spine section.

7. In a ring binder having a ring metal formed of a pair of leaves hingedly connected to each other for relative movement therebetween, a plurality of binder rings each formed of a pair of ring halves, one end of each ring half being attached to a separate one of the leaves whereby movement of the leaves moves the ring halves to open and close the ring binder, and a shield covering said leaves, the improvement comprising a release lever located at one end of said shield and operable by a user of said ring binder to move said leaves to open and close the binder, said release lever including a finger plate sized to receive a finger of the user to open or close the ring binder and a lever arm contacting said leaves for movement of said release levers to effect movement of said leaves upon actuation of said finger plate by the user, said finger plate extending substantially co-planar to said shield, the length of said shield and said finger plate generally corresponding to the length of a sheet paper stored in the binder so to form a low profile ring metal by which the overall size of said ring binder is smaller than that of a ring binder for holding the same size sheets of paper but having a conventional ring metal construction.

8. The improvement of claim 7 further including an opening in said finger plate, said openings being sized for insertion of a fastener therethrough, and a bolster connected to said release lever, said bolster having an opening formed therein sized to receive said fastener therethrough, said fastener being used to secure said bolster to said binder.

9. The improvement of claim 8 wherein said lever arm is a U-shaped lever arm extending through an opening formed in said bolster for said arm to press against one side of said leaves to open said binder and an opposite side of said leaves to close said binder.

10. The improvement of claim 7 wherein said shield has an arcuate contour, and said finger plate has an arcuate contour corresponding to the contour of said cover.

11. The improvement of claim 10 wherein the outer ends said finger plate is beveled inwardly to reduce the amount of material required to fabricate the levers.

12. A low profile ring metal for use in a ring binder for storing hole punched sheets of paper and similar materials comprising:

a pair of leaves hingedly connected to each other for relative movement therebetween;

a plurality of spaced binder rings each of which is formed of a pair of ring halves, one end of each ring half attached to a separate one of the leaves for movement of said leaves to move the ring halves forming said binder rings out of and into contact with each other to open and close the ring binder;

a shield covering said leaves and having openings therein through which said ring halves extend; and, two release levers with one release lever being located at each end of said cover and operable by a user of said ring binder to move said leaves to open and close the binder, each of said release levers including a finger plate sized to receive a finger of the user to open or close the ring binder and a lever arm contacting said leaves for movement of said release levers to effect movement of said leaves upon actuation of said finger plate by the user, said finger plates extending substantially co-planar to said shield and including means facilitating attachment of said ring metal to said ring binder with the resulting spacing between said ring metal and said ring binder being such as to substantially reduce the probability of the binder being inadvertently opened by a throw of paper, and the length of said shield and said finger plates generally corresponding to the length of a sheet paper stored in the binder thereby allowing the overall size of the binder to be smaller than that of a ring binder for holding the same size sheets of paper but using a conventional ring metal construction.

13. The ring metal of claim 12 wherein said raised sections of said shield have an arcuate contour, and said finger plates each have an arcuate contour corresponding to the contour of said raised sections of said shield.

14. The ring metal of claim 13 wherein the outer ends of each of said finger plates are beveled inwardly to reduce the amount of material required to fabricate the levers.

15. The ring metal of claim 12 wherein said lever arm is a U-shaped lever arm extending through an opening formed in said leaves for said arm to press against one side of said leaves to open said binder and an opposite side of said leaves to close said binder.

16. The ring metal of claim 12 wherein said means facilitating attachment of said ring metal to said ring binder includes an opening in each of said finger plates, said openings being sized for insertion of a fastener therethrough, said fastener being used to secure said ring metal to said binder.

17. The ring metal of claim 16 wherein said ring binder includes respective end covers and a spine between said end covers, said ring metal being attachable to said spine, and said fastener includes a rivet insertable through said openings in said finger plates for securing said ring metal to said ring binder.

18. The ring metal of claim 17 further including bolsters at each end of said ring metal that are connected to said release levers, said bolsters having openings formed therein that are sized to receive said fasteners, said fasteners being used to secure said bolsters to said spine section.

* * * * *

UNITED STATES PATENT AND TRADEMARK OFFICE

CERTIFICATE OF CORRECTION

PATENT NO. : 5,816,729
APPLICATION NO. : 08/806056
DATED : October 6, 1998
INVENTOR(S) : Paul Whaley It is certified that error appears in the above-identified patent and that said Letters Patent is hereby corrected as shown below:

Col. 5, Line 3
Replace “said release levers”
with -- said release lever --

Col. 5, Line 20
Replace “said release levers”
with -- said release lever --

Col. 5, Line 21
Replace “the levers”
with -- the lever --

Col. 5, Line 51
Replace “said release levers”
with -- said release lever --

Col. 6, Line 9
Replace “the levers”
with -- the lever --

Signed and Sealed this

Twenty-first Day of April, 2009

John Doll

JOHN DOLL
*Acting Director of the United States Patent and Trademark Office*